US010755882B2

(12) United States Patent
Huang et al.

(10) Patent No.: US 10,755,882 B2
(45) Date of Patent: Aug. 25, 2020

(54) RELAY

(71) Applicant: BYD COMPANY LIMITED, Shenzhen, Guangdong (CN)

(72) Inventors: Caili Huang, Shenzhen (CN); Baotong Yao, Shenzhen (CN); Lujian Wang, Shenzhen (CN); Siyuan Liu, Shenzhen (CN)

(73) Assignee: BYD COMPANY LIMITED, Shenzhen, Guangdong (CN)

( * ) Notice: Subject to any disclaimer, the term of this patent is extended or adjusted under 35 U.S.C. 154(b) by 78 days.

(21) Appl. No.: 16/084,211

(22) PCT Filed: Mar. 17, 2017

(86) PCT No.: PCT/CN2017/077155
§ 371 (c)(1),
(2) Date: Sep. 11, 2018

(87) PCT Pub. No.: WO2017/157341
PCT Pub. Date: Sep. 21, 2017

(65) Prior Publication Data

US 2019/0074151 A1 Mar. 7, 2019

(30) Foreign Application Priority Data

Mar. 18, 2016 (CN) ..... 2016 1 0157466

(51) Int. Cl.
*H01H 50/54* (2006.01)
*H01H 50/58* (2006.01)
(Continued)

(52) U.S. Cl.
CPC ..... *H01H 50/546* (2013.01); *H01H 1/20* (2013.01); *H01H 9/0066* (2013.01);
(Continued)

(58) Field of Classification Search
CPC ..... H01H 50/546; H01H 1/20; H01H 9/0066; H01H 50/047; H01H 50/14; H01H 50/36;
(Continued)

(56) References Cited

FOREIGN PATENT DOCUMENTS

CN 204102809 U 1/2015
CN 104810207 A 7/2015
(Continued)

OTHER PUBLICATIONS

International Search Report from PCT/CN2017/077155 dated Jun. 2, 2017 (2 pages).

*Primary Examiner* — Mohamad A Musleh
(74) *Attorney, Agent, or Firm* — Calfee, Halter & Griswold LLP

(57) ABSTRACT

The present subject matter provides a relay, including an insulating cover, two static contact bridges, a moving contact bridge, a drive shaft and a driving mechanism; a conductive layer is provided on the inner surface of the top of the insulating cover; the relay comprises an auxiliary conduction structure and an auxiliary detection structure; the auxiliary conduction structure includes a conductive member and an elastic member that elastically supports the conductive member below; the conductive member is arranged on the drive shaft, the drive shaft moves up to drive the moving contact bridge to be conducted with the static contact bridges, and the conductive member is conducted with the conductive layer; the drive shaft moves down to drive the moving contact bridge to be disconnected from the static contact bridges, and the conductive member is disconnected from the conductive layer; the auxiliary detection structure comprises a first auxiliary terminal and a second auxiliary terminal; the first auxiliary terminal is electrically connected to the conductive layer; and the second auxiliary terminal is electrically connected to the conductive member.

20 Claims, 9 Drawing Sheets

(51) Int. Cl.

| | |
|---|---|
| ***H01H 9/00*** | (2006.01) |
| ***H01H 1/20*** | (2006.01) |
| ***H01H 50/04*** | (2006.01) |
| ***H01H 50/14*** | (2006.01) |
| ***H01H 50/36*** | (2006.01) |
| ***H01H 50/44*** | (2006.01) |
| *H01H 50/08* | (2006.01) |

(52) U.S. Cl.
CPC ..... *H01H 50/047* (2013.01); *H01H 50/14* (2013.01); *H01H 50/36* (2013.01); *H01H 50/443* (2013.01); *H01H 50/541* (2013.01); *H01H 50/58* (2013.01); *H01H 50/08* (2013.01)

(58) Field of Classification Search
CPC .... H01H 50/443; H01H 50/541; H01H 50/58; H01H 50/08
See application file for complete search history.

(56) References Cited

FOREIGN PATENT DOCUMENTS

| | | | | |
|---|---|---|---|---|
| EP | 2192605 | A1 * | 6/2010 | ..... H01H 50/546 |
| WO | 2014083770 | A1 | 6/2014 | |

* cited by examiner

RELAY

CROSS-REFERENCE TO RELATED APPLICATIONS

This application is a 371 of PCT Application No. PCT/CN2017/077155 filed on Mar. 17, 2017, which claim priority to Chinese Application No. 201610157466.1 filed on Mar. 18, 2016, the contents of which are hereby incorporated by reference as if recited in their entirety.

TECHNICAL FIELD

The present application relates to the field of relays.

BACKGROUND

The existing relay generally includes an insulating cover, two static contact bridges, a moving contact bridge, a drive shaft and a driving mechanism. The two static contact bridges are fixedly mounted on the insulating cover. The upper end of the drive shaft stretches into the insulating cover, and the moving contact bridge is mounted at the upper end of the drive shaft through an insulating component. The driving mechanism is mounted at the lower end of the drive shaft for driving the drive shaft to drive the moving contact bridge to move, so that the two static contact bridges are attracted and coupled to or are disconnected from the moving contact bridge. The points where the static contact bridges are in contact with the moving contact bridge are called contacts, the contacts on the static contact bridges are called static contacts, and the contacts on the moving contact bridge are called moving contacts.

The driving mechanism is generally composed of a moving core, a static core, a coil, a yoke, a reset spring and the like. When the coil is powered on, the static core produces electromagnetic attraction, the moving core drives the drive shaft to move up against the elastic force of the reset spring under the action of the electromagnetic attraction, and the drive shaft drives the moving contact bridge to contact the static contact bridges fixed on the insulating cover so as to turn on the relay. When the coil is powered off, the electromagnetic attraction produced by the static core disappears, and the reset spring drives the drive shaft to move down, so that the moving contact bridge is separated from the static contact bridge to turn off the relay.

However, during the research, development and production of the relay, the applicant discovered that the existing relay has a fault sometimes that the contacts are not conducted when the relay should be turned on or the contacts are still stuck when the contacts should be separated, causing failure of the relay and safety accidents.

SUMMARY

The present subject matter provides a relay in order to overcome the problems of failure of the relay and safety accidents due to the fact that the existing relay has a fault sometimes that the contacts are not conducted when the relay should be turned on or the contacts are still stuck when the contacts should be separated.

The present subject matter provides a relay, including an insulating cover, two static contact bridges, a moving contact bridge, a drive shaft and a driving mechanism; the two static contact bridges are fixedly mounted on the insulating cover; the upper end of the drive shaft stretches into the insulating cover, and the moving contact bridge is mounted at the upper portion of the drive shaft; the driving mechanism is mounted at the lower end of the drive shaft for driving the drive shaft to drive the moving contact bridge to move; the inner surface of the top of the insulating cover has a yielding portion into which the top of the drive shaft stretches; the inner surface of the top of the insulating cover is also provided with a conductive layer; the relay further includes an auxiliary conduction structure and an auxiliary detection structure; the auxiliary conduction structure includes an elastic member and a conductive member; the elastic member elastically supports the conductive member under the conductive member; the conductive member is movably arranged on the drive shaft along the drive shaft; the upward movement of the drive shaft can drive the moving contact bridge to be conducted with the static contact bridges, and at the same time, drives the conductive member to be in contact with and conducted with the conductive layer; the downward movement of the drive shaft can drive the moving contact bridge to be disconnected from the static contact bridges, and at the same time, drives the conductive member to be disconnected from the conductive layer; the auxiliary detection structure includes a first auxiliary terminal and a second auxiliary terminal; the first auxiliary terminal is arranged at the top of the insulating cover and electrically connected to the conductive layer; and the second auxiliary terminal is electrically connected to the conductive member.

According to the relay provided by the present subject matter, an auxiliary detection structure is added on the basis of the existing relay, and the first auxiliary terminal and the second auxiliary terminal are connected to an external auxiliary detection circuit in use. When the drive shaft moves up so that the moving contact bridge is in contact with the two static contact bridges at the same time, the relay is turned on. At this time, the conductive member moves up synchronously with the drive shaft and is in contact with conducted with the conductive layer, and the first auxiliary terminal is conducted with the second auxiliary terminal through the conductive member and the drive shaft. When the drive shaft moves down so that the moving contact bridge is separated from the two static contact bridges at the same time, the relay is turned off. At this time, the conductive member moves down synchronously with the drive shaft and is separated from the conductive layer. The first auxiliary terminal is disconnected from the second auxiliary terminal. In this way, as the contacts are not conducted when the relay should be turned on or the contacts are still stuck when the contacts should be disconnected, the fault can be quickly detected through the auxiliary detection circuit, and measures can be taken in time to prevent safety accidents caused by failure of the relay.

The two blocking portions can increase the creepage distance between the two static contact bridges, and can also increase the creepage distance between the conductive layer and the static contact bridges, thereby ensuring the safety of the auxiliary circuit. In addition, the blocking portions can prevent copper cuttings from splashing during arc discharge to accidentally conduct the static contact bridges and the conductive layer so as to destroy the determination accuracy and safety of the auxiliary circuit.

Figure 1:
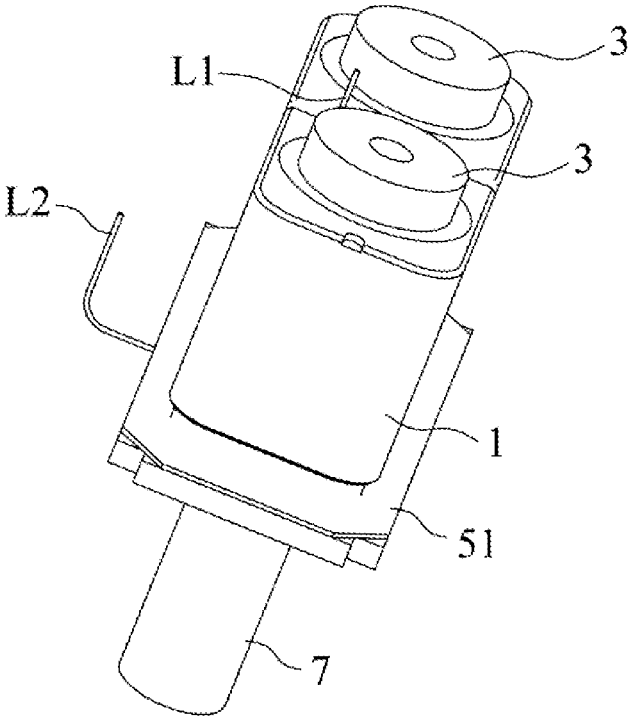
FIG. 1 is a stereogram of a relay according to an embodiment of the present subject matter.
Figure 2:
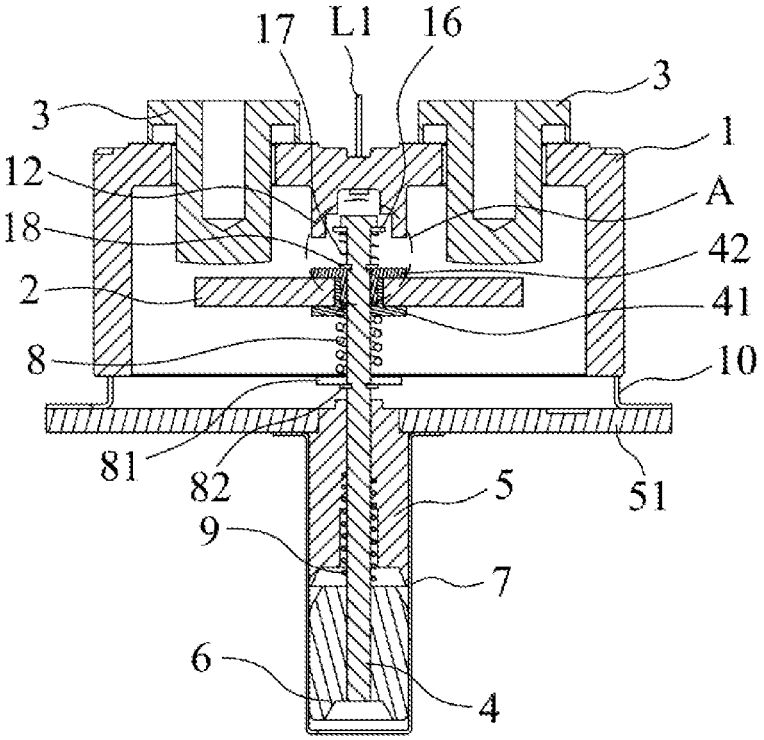
FIG. 2 is a schematic diagram of the front center section of the relay in a turn-off state according to an embodiment of the present subject matter.
Figure 3:
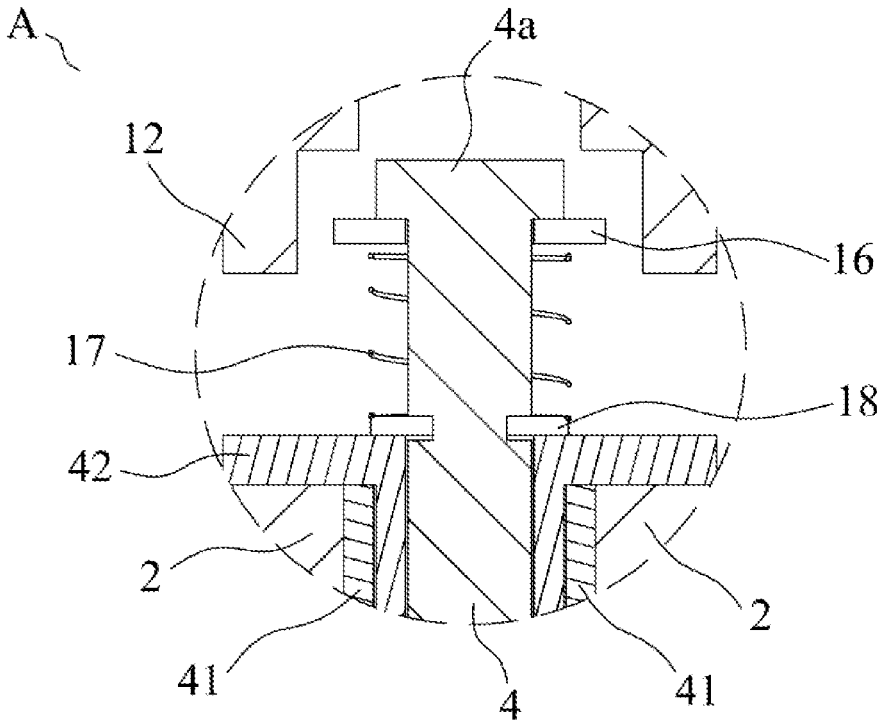
FIG. 3 is an enlarged schematic diagram of A in FIG. 2.
Figure 4:
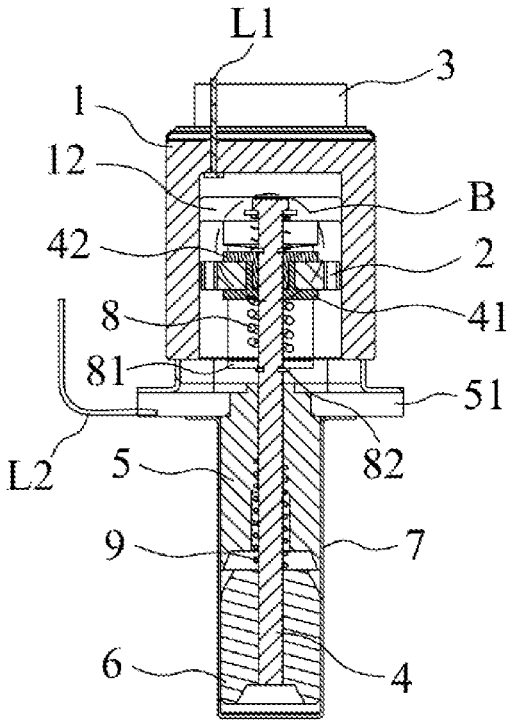
FIG. 4 is a schematic diagram of the side center section of the relay in the turn-off state according to an embodiment of the present subject matter.
Figure 5:
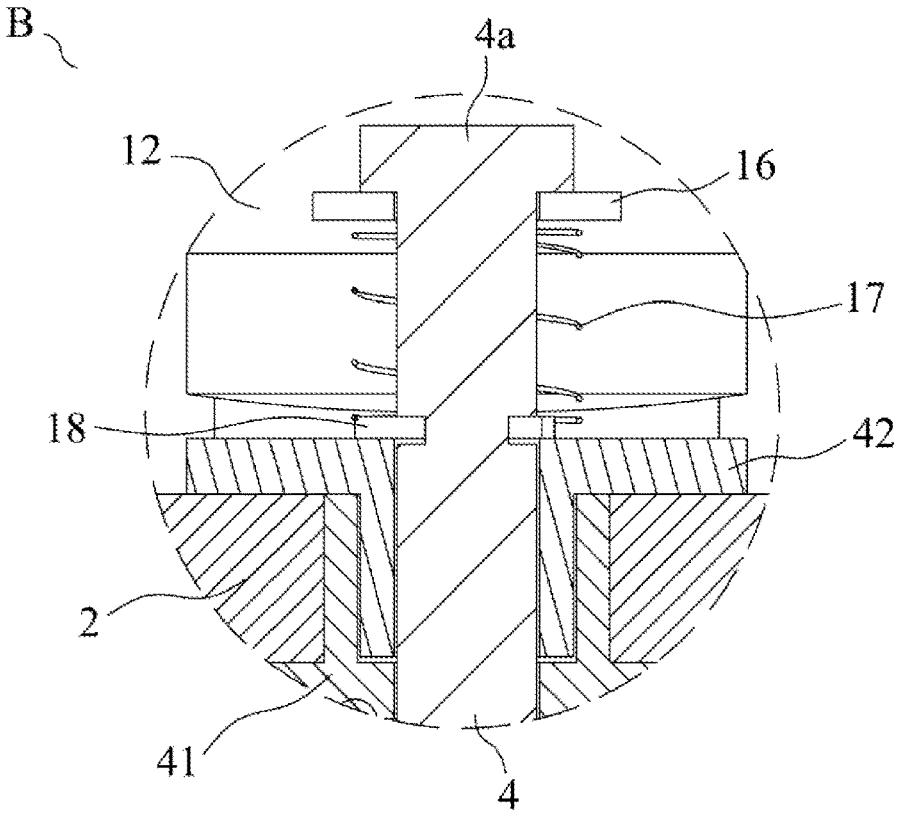
FIG. 5 is an enlarged schematic diagram of B in FIG. 4.
Figure 6:
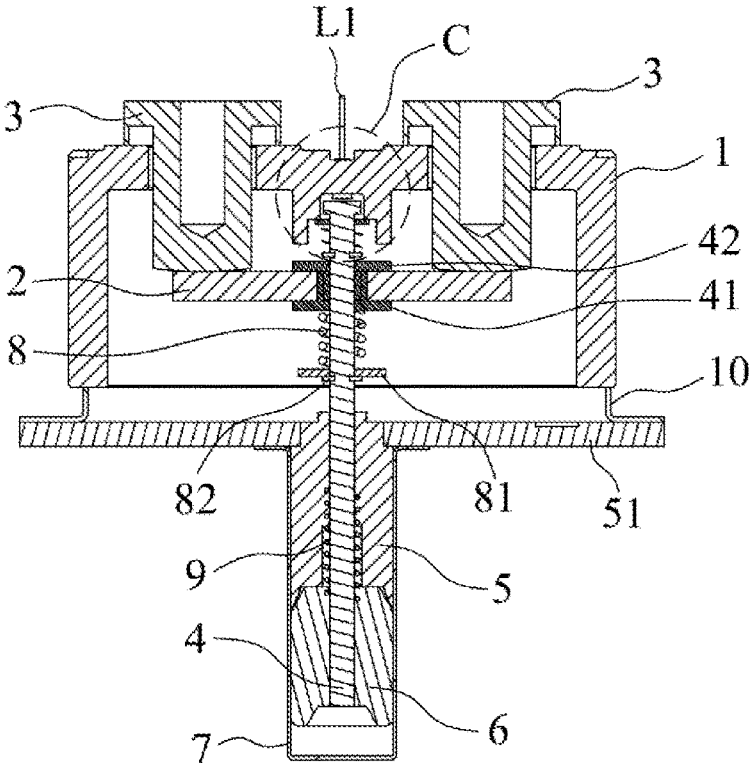
FIG. 6 is a schematic diagram of the front center section of the relay in a turn-on state according to an embodiment of the present subject matter.
Figure 7:
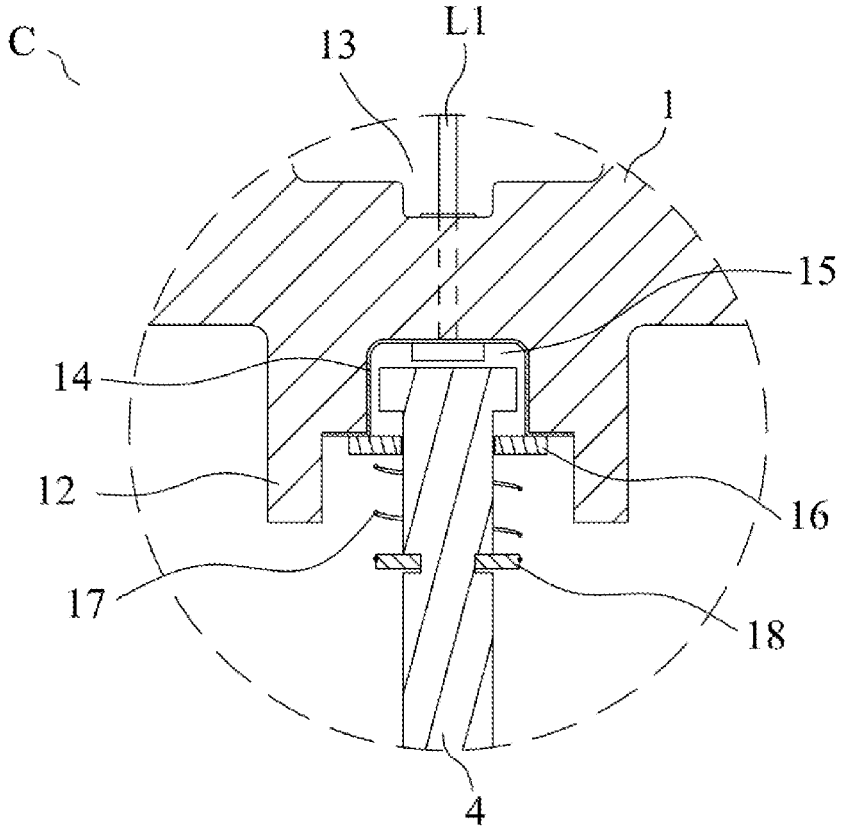
FIG. 7 is an enlarged schematic diagram of C in FIG. 6.
Figure 8:
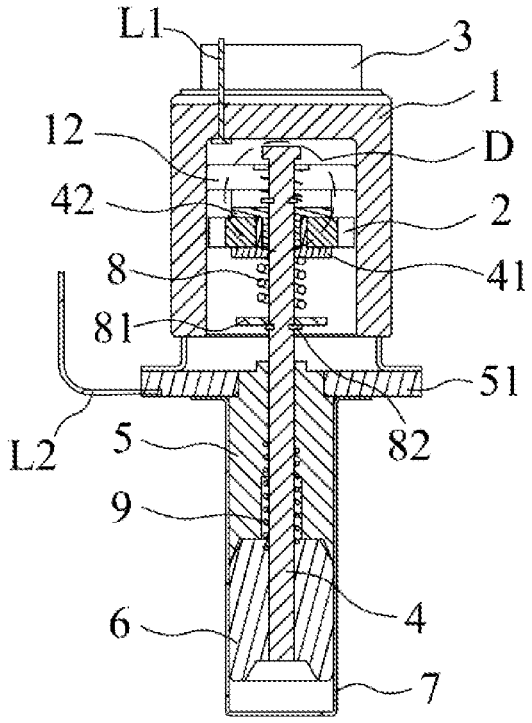
FIG. 8 is a schematic diagram of the side center section of the relay in the turn-on state according to an embodiment of the present subject matter.
Figure 9:
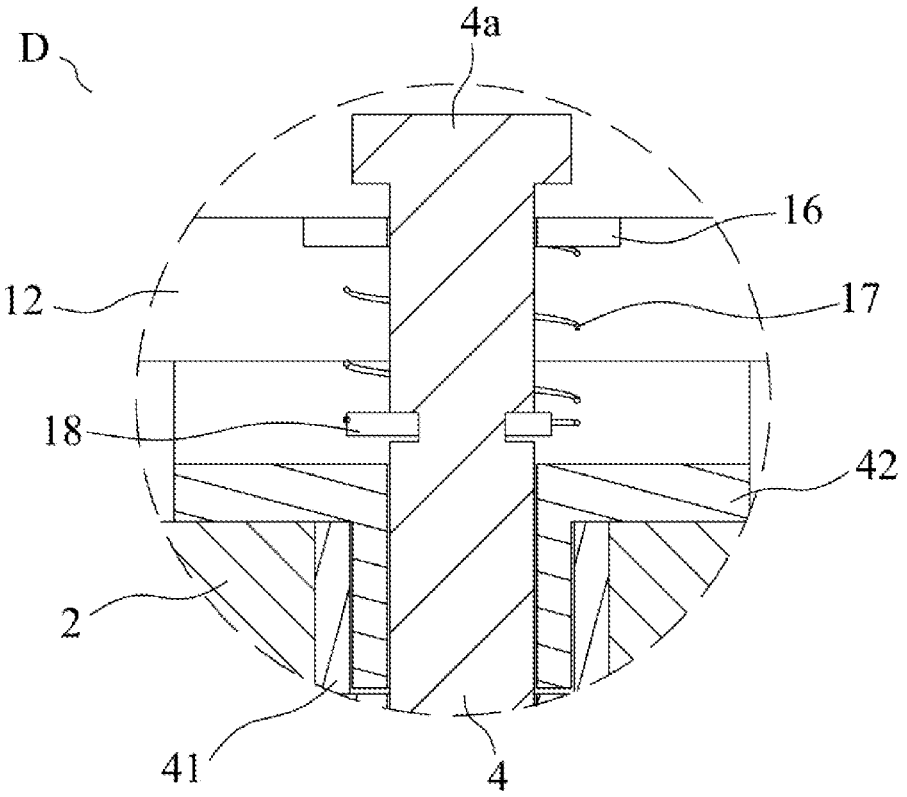
FIG. 9 is an enlarged schematic diagram of D in FIG. 8.
Figure 10:
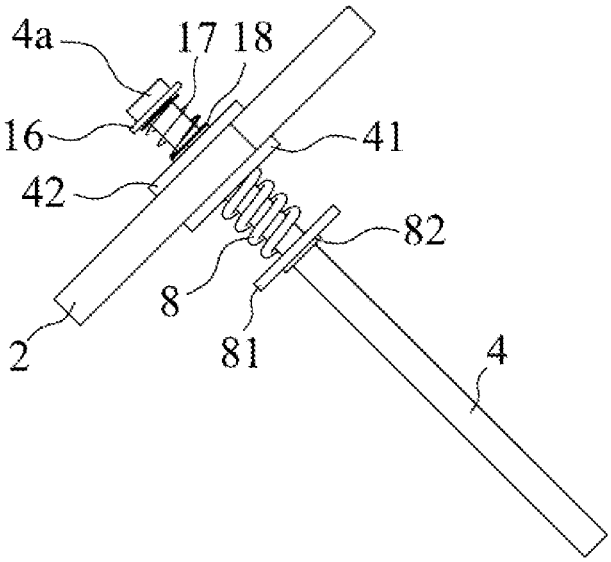
FIG. 10 is a stereogram of an assembled state of a drive shaft and an auxiliary conduction structure in the relay according to an embodiment of the present subject matter.
Figure 11:
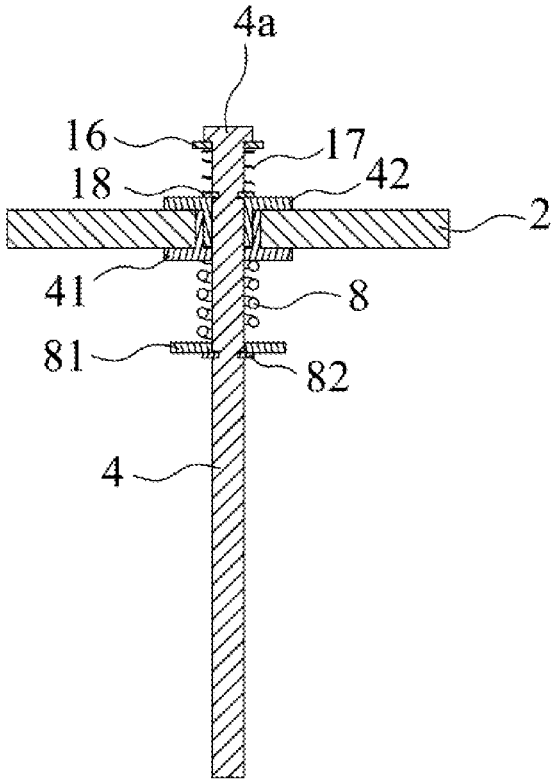
FIG. 11 is a sectional view of the assembled state of the drive shaft and the auxiliary conduction structure in the relay according to an embodiment of the present subject matter.
Figure 12:
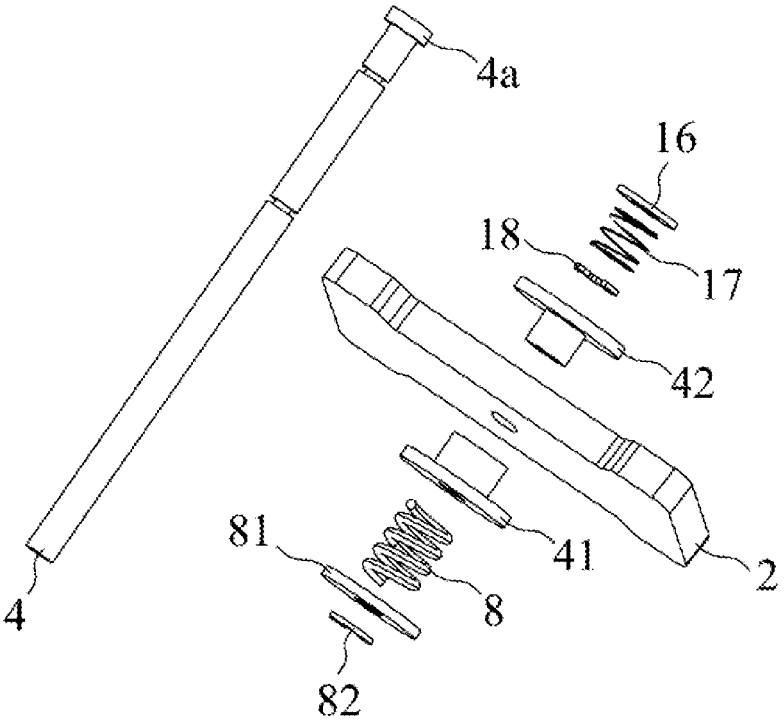
FIG. 12 is an exploded view of the drive shaft and the auxiliary conduction structure in the relay according to an embodiment of the present subject matter.

wherein, 1, insulating cover; 2, moving contact bridge; 3, static contact bridge; 4, drive shaft; 5, static core; 6, moving core; 7, sleeve; 8, buffer spring; 9, reset spring 10, connecting table; 11, static contact hole; 12, blocking portion; 13, clearance slot; 14, conductive layer; 15, inner groove; 15', inner recessed hole; L1, first auxiliary terminal; L2, second auxiliary terminal; 4*a*, limiting portion; 41; lower insulating cover; 42; upper insulating cover; 51, upper yoke; 81, washer; 82, clamping spring; 16, conductive member; 17, auxiliary spring; 18, conductive fixed member.

DETAILED DESCRIPTION OF THE EMBODIMENTS

In order to make the technical problems solved, technical solutions and advantages of the present subject matter clearer, the following describes the present subject matter in detail in combination with the accompanying drawings and embodiments. It should be understood that the detailed embodiments described herein are only used for interpreting the present subject matter, rather than limiting the present subject matter.

In the description of the present subject matter, it should be understood that the terms "upper", "lower", "top", "bottom", "inner", "outer" and the like indicate the orientations or positional relationships based on the orientations or positional relationships shown in the drawings. The terms are only for description convenience of the present subject matter and simplification of the description, but do not indicate or imply that the pointed devices or units must have specific orientations or be constructed and operated in specific orientations. Therefore, the terms should not be understood to limit the present subject matter.

In the description of the present subject matter, it should be noted that, unless otherwise specified and defined, the terms "mounted", "set" and "connected" should be generally understood, for example, the "connected" may be fixedly connected, detachably connected or integrally connected. Those of ordinary skill in the art can understand the specific meanings of the above terms in the present subject matter according to specific circumstances.

FIGS. 1-15 illustrate embodiments of a relay provided by the present subject matter.

The relay includes an insulating cover 1, two static contact bridges 3, a moving contact bridge 2, a drive shaft 4 and a driving mechanism.

The insulating cover 1 is made of a conventional material and has a conventional structure. Generally, in the art, the insulating cover 1 is made of a ceramic material.

The two static contact bridges 3 are fixedly mounted on the insulating cover 1.

The upper end of the drive shaft 4 stretches into the insulating cover 1, the moving contact bridge 2 is mounted at the upper portion of the drive shaft 4 through an insulating component, and the insulating component is fixed to the moving contact bridge 2. The insulating component, together with the moving contact bridge 2, can move up and down along the drive shaft 4. The structure and material of the drive shaft 4 may be the same as those in the prior art, for example, the drive shaft 4 may be a conductor or an insulator.

The driving mechanism is mounted at the lower end of the drive shaft 4 for driving the drive shaft 4 to drive the moving contact bridge 2 to move so that the moving contact bridge 2 is conducted with or disconnected from the two static contact bridges 3.

The moving contact bridge 2 and the static contact bridges 3 are well known to the public. The moving contact bridge 2 may be a metal sheet with a hole in the center, the positions where the moving contact bridge 2 is in contact with the static contact bridges 3 are called moving contacts, and the moving contact bridge 2 is mounted at the upper end of the drive shaft 4. In order to avoid electric leakage from the drive shaft 4, it is necessary to ensure that no leakage path is formed between the moving contact bridge 2 and the drive shaft 4 in the relay. Thus, when the drive shaft 4 is an insulator, the moving contact bridge 2 can be directly arranged on the drive shaft 4. When the drive shaft 4 is a conductor, the moving contact bridge 2 needs to be arranged on the drive shaft 4 through an insulating component. In the present embodiment, the drive shaft 4 is a conductor, and the moving contact bridge 2 needs to be arranged on the drive shaft 4 through an insulating component. For example, after the upper end of the drive shaft 4 is sleeved with the insulating component, the moving contact bridge 2 is mounted on the insulating component. The insulating component insulates the moving contact bridge 2 from the drive shaft 4, while the moving contact bridge 2 and the insulating component, which are fixed to each other, can move along the drive shaft 4.

Figure 13:
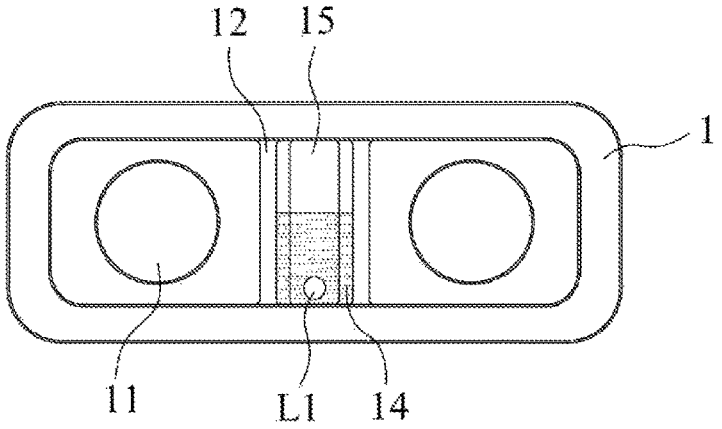
FIG. 13 is a bottom view of an assembly state of an insulating cover and a first auxiliary terminal in the relay according to an embodiment of the present subject matter.
Figure 14:
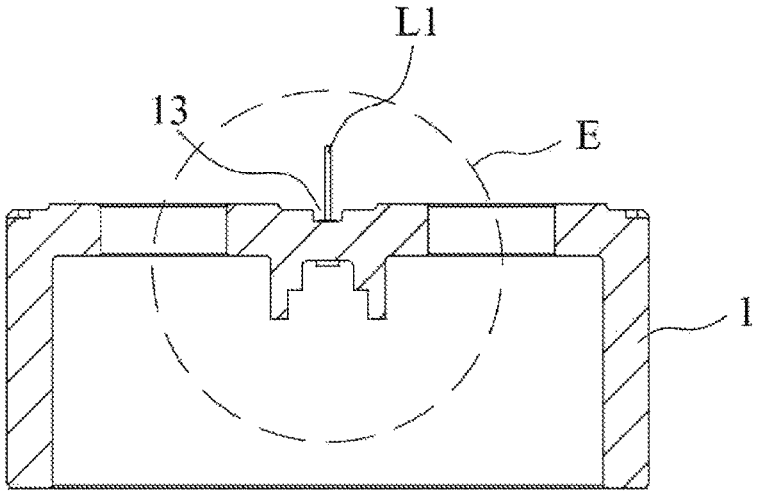
FIG. 14 is a schematic diagram of the front center section of the assembly state of the insulating cover and the first auxiliary terminal in the relay according to an embodiment of the present subject matter.

The static contact bridges 3 are generally mounted on the insulating cover 1 by brazing. Specifically, as shown in FIG. 13 and FIG. 14, the top surface of the insulating cover 1 is provided with two mounting holes, static contact holes 11 for short, for mounting the static contact bridges 3, and the two static contact bridges 3 are brazed in the two static contact holes 11.

Each static contact bridge 3 includes an inner end extending into the insulating cover 1 and an outer end extending out of the insulating cover 1. The inner end is used for contacting with the moving contact bridge 2, and the position for contacting is called a static contact. A connecting hole is formed at the outer end to connect with a wire of an external main circuit. After the static contact bridges 3 are connected with the external main circuit through the connecting holes, the moving contact bridge 2, the static contact bridges 3 and the external high-voltage circuit form a circuit. The contact and separation of the moving contacts and the static contacts achieve on and off of the main circuit in the relay.

Wherein, the insulating component is used for insulating and isolating the moving contact bridge 2 from the drive shaft 4, and may be the one known in the art. In this example, as shown in FIGS. 2-9, the insulating component includes an upper insulating cover 42 and a lower insulating cover 41. The upper insulating cover 42 and the lower insulating cover 41 are combined and sleeved on the drive shaft 4 to mount the moving contact bridge 2 on the drive shaft 4 and insulate it from the drive shaft 4, and the moving contact bridge 2 and the insulating component fixed to each other can move along the drive shaft 4. The upper insulating cover 42 and the lower insulating cover 41 isolate the drive shaft 4 from the moving contact bridge 2 and the static contact bridges 3, and then insulate high and low voltages to avoid damage and breakdown of low-voltage components, thereby improving the quality and safety of the product.

The driving mechanism may be various mechanisms known to those skilled in the art. In this example, as shown in FIGS. 1-12, the driving mechanism includes an upper yoke 51, a static core 5, a moving core 6, a sleeve 7, a reset spring 9, a buffer spring 8 and a coil (not shown in the figures).

The upper yoke 51 is connected with the insulating cover 1 through a connecting table 10. An enclosed space is formed between the upper yoke 51 and the insulating cover 1. A shaft hole is provided in the center of the upper yoke 51. Due to the influence of the material, the upper yoke 51 cannot be welded directly to the insulating cover 1. Thus, the connection between the upper yoke 51 and the insulating cover 1 is accomplished by the connecting table 10. The connecting table 10 is made of a metal material and welded to the lower portion of the insulating cover 1 in advance, and then the upper yoke 51 is welded to the connecting table 10.

The lower end of the drive shaft 4 extends out of the shaft hole in the center of the upper yoke 51, the static core 5 is sleeved on the drive shaft 4 below the upper yoke 51, and the drive shaft 4 can move up and down relative to the static core 5. The moving core 6 is fixedly mounted at the lower end of the drive shaft 4. The moving core 6 is located below the static core 5. That is, the upper end of the drive shaft 4 penetrates through the shaft hole of the upper yoke 51 and stretches into the enclosed space formed between the upper yoke 51 and the insulating cover 1. Specifically, the moving core 6 is fixed at the lower end of the drive shaft 4 by laser welding or threaded connection.

The circuit formed by the coil is a control circuit, and the on and off of the control circuit control the electromagnetic attraction of the static core 5. Both the moving contacts and the static contacts are contacts constituting the main circuit of the relay. In order to distinguish from the contact where the conductive layer 14 of the subsequent first auxiliary terminal L1 is electrically connected with the conductive member 16 on the drive shaft 4, the static contacts and the moving contacts are classified as main contacts, and the contact position between the conductive layer 14 and the conductive member 16 is called an auxiliary contact.

The reset spring 9 is sleeved on the drive shaft 4 between the static core 5 and the moving core 6, and the two ends of the reset spring 9 respectively abut against the static core 5 and the moving core 6 to apply tensions to the moving core 6 and the static core 5 for separating them from each other. The reset spring 9 is arranged between the static core 5 and the moving core 6. When the coil is powered on, the moving core 6 moves up due to the electromagnetic attraction of the static core 5 to compress the reset spring 9 to accumulate elastic force. When the coil is powered off, the reset spring 9 is reset under the action of the elastic force to drive the moving core 6 to move down.

The buffer spring 8 is sleeved on the drive shaft 4 in the enclosed space between the upper yoke 51 and the insulating cover 1, the upper end of the buffer spring 8 abuts against the lower insulating cover 41, the lower end of the buffer spring 8 abuts against a washer 81, and the lower end of the washer 81 is limited by a clamping spring 82. The washer 81 can reduce the force applied on the clamping spring 82 to prevent it from dropping.

The sleeve 7 is sleeved outside the static core 5 and the moving core 6, with an upper opening welded with the upper yoke 51.

The coil (not shown in the figures) is mounted outside the sleeve 7 below the upper yoke 51.

Since the upper yoke 51, the static core 5, the moving core 6, the sleeve 7 and the drive shaft 4 are all made of metal, these components are all in electrical communication, and for convenience of description, they are referred to as core metal members.

The object of the present subject matter is to provide an auxiliary structure in the relay to determine whether the relay is actually conducted.

Figure 15:
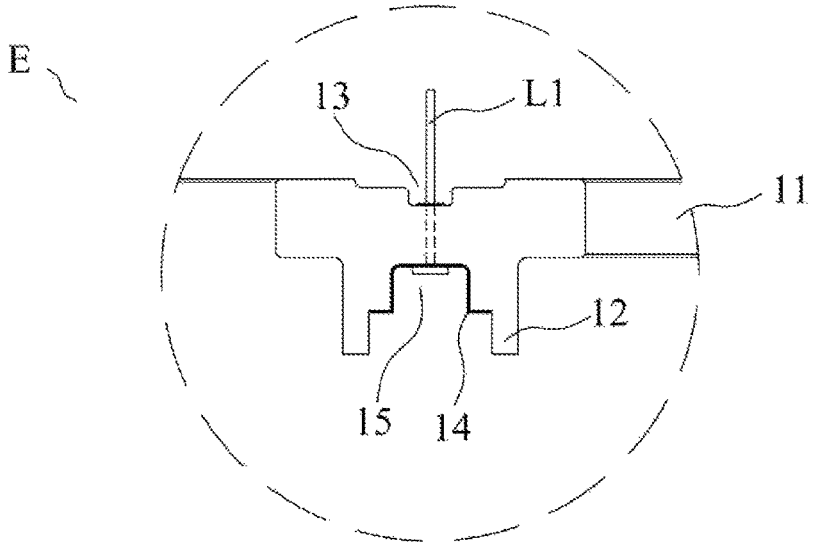
FIG. 15 is an enlarged schematic diagram of E in FIG. 14.
Figure 16:
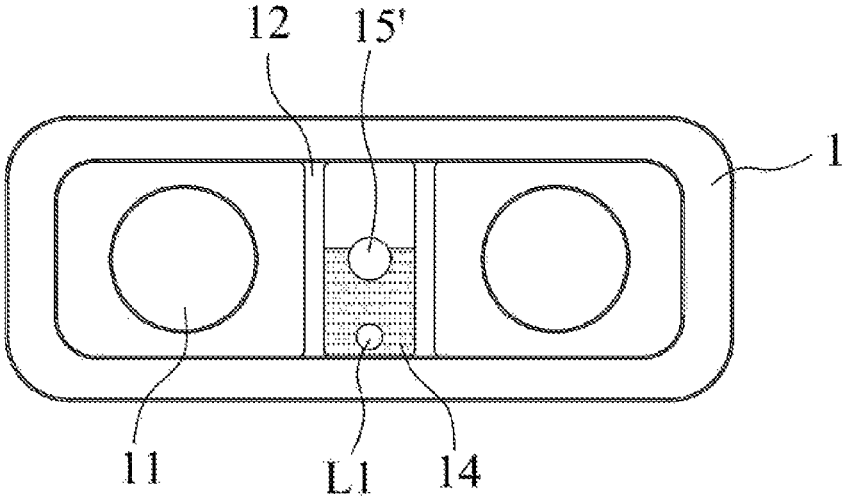
FIG. 16 is a bottom view of the assembly state of the insulating cover and the first auxiliary terminal in another embodiment of the present subject matter.
Figure 17:
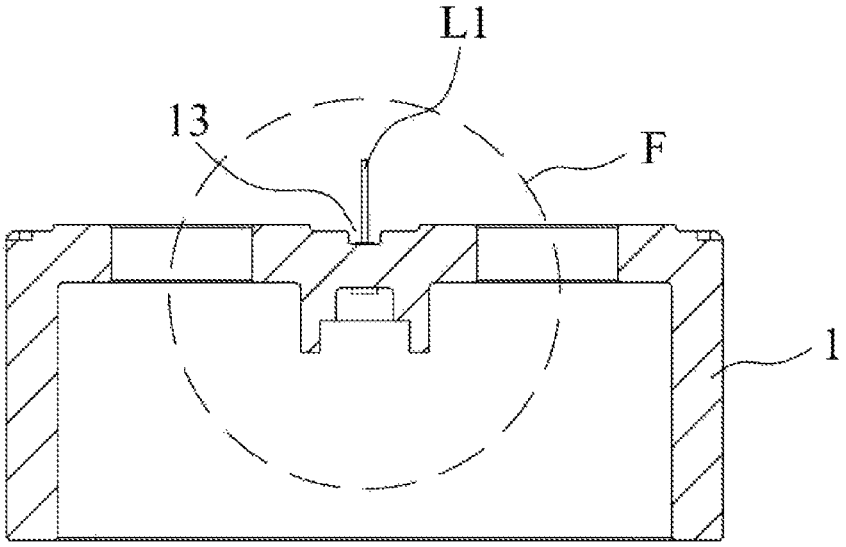
FIG. 17 is a schematic diagram of the front center section of the assembly state of the insulating cover and the first auxiliary terminal in another embodiment of the present subject matter.
Figure 18:
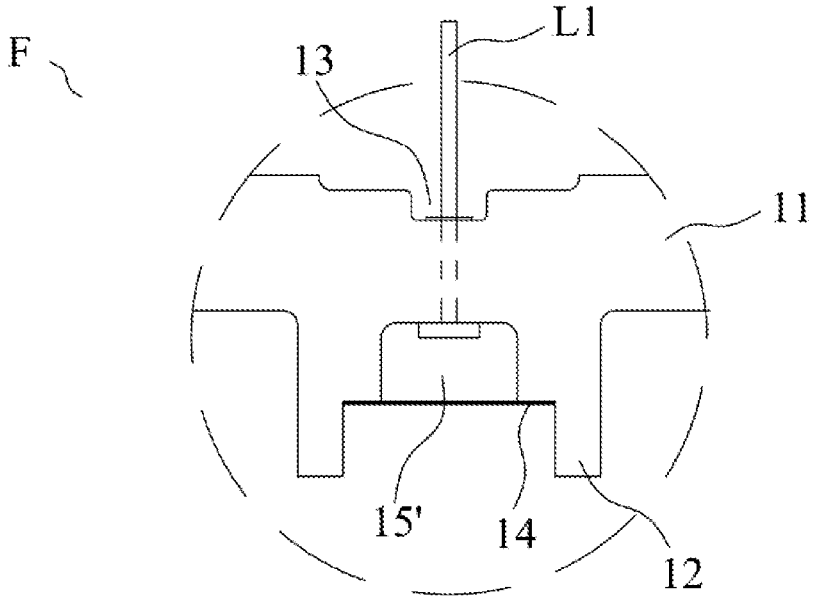
FIG. 18 is an enlarged schematic diagram of F in FIG. 17.

For the insulating cover 1 in the relay, in order to avoid interference between the top end of the drive shaft 4 and the top of the insulating cover 1 during the up and down movement of the drive shaft 4, the inner surface of the top of the insulating cover 1 has a yielding portion into which the top of the drive shaft 4 stretches. The structure of the yielding portion can be a variety of conventional structures, as long as it satisfies that the top of the drive shaft 4 can stretch and leave. For example, the yielding portion may be directly sunken inward from the inner surface of the top of the insulating cover 1 (i.e., the direction from the inner surface of the top of the insulating cover to the outer surface of the top of the insulating cover), or the inner surface of the top of the insulating cover 1 has a boss extending down, and the lower surface of the boss is partially sunken inward to form the yielding portion. For example, in this embodiment, the lower surface of the boss is partially sunken inward to form the yielding portion, and the yielding portion may be an inner groove 15 (as shown in FIG. 13 to FIG. 15) or an inner recessed hole 15' (as shown in FIG. 16 to FIG. 18).

At the same time, the inner surface of the top of the insulating cover 1 is also provided with a conductive layer 14. The object of providing the conductive layer 14 is to achieve electrical contact with the conductive member 16 arranged on the drive shaft 4 when the drive shaft 4 moves up. It can be understood that the surface at the opening of the yielding portion is a part in electrical contact with the conductive member 16. Thus, the coverage area of the conductive layer 14 should at least cover the part of the insulating cover 1 in corresponding contact with the conductive member 16. When the yielding portion is the inner recessed hole 15', the conductive layer 14 covers at least part of the lower surface of the boss at the edge of the inner recessed hole 15'. When the yielding portion is the inner groove 15, the conductive layer 14 simultaneously covers at least part of the lower surface of the boss and part of the inner surface of the inner groove 15.

The conductive layer 14 may be a conventional metal layer, that is, the corresponding area on the ceramic is metalized. The process and method for forming the metal layer on the surface of the ceramic are existing and will not be described in detail in the present subject matter.

The above relay includes an auxiliary conduction structure and an auxiliary detection structure. As shown in FIGS. 1 to 9, the auxiliary detection structure includes a first auxiliary terminal L1 and a second auxiliary terminal L2.

The first auxiliary terminal L1 is arranged at the top of the insulating cover 1 and electrically connected to the conductive layer 14. For example, an auxiliary terminal hole penetrating the top of the insulating cover 1 may be provided at the top of the insulating cover 1. Theoretically, the auxiliary terminal hole may be provided at any position on the insulating cover 1, as long as the first auxiliary terminal L1 can be electrically connected with the conductive layer 14 through the auxiliary terminal hole. To facilitate machining and simplify the process, the auxiliary terminal hole is located within the coverage area of the conductive layer 14. The auxiliary terminal hole may be provided in the center between the two static contact bridges 3. In this embodiment, in order to increase the creepage distance between the first auxiliary terminal L1 and the static contact bridges 3, the auxiliary terminal hole is located at a position behind the center between the two static contact bridges 3, specifically, the auxiliary terminal hole is located at the edge of the insulating cover 1, and at this time, the connecting lines between the auxiliary terminal hole and the two static contact bridges 3 form an isosceles triangle (as shown in FIG. 13 or FIG. 16).

It can be understood that the auxiliary terminal hole may be located within or beyond the inner groove 15 or the inner recessed hole 15'. When the auxiliary terminal hole is located beyond the inner groove 15 or the inner recessed hole 15', the conductive layer 14 only needs to cover the position of the auxiliary terminal hole. When the auxiliary terminal hole is located within the inner groove 15 or the inner recessed hole 15', the conductive layer 14 covers at least the bottom surface of the inner groove 15 or the inner recessed hole 15' where the auxiliary terminal hole is located.

The first auxiliary terminal L1 is arranged on the insulating cover 1 through the auxiliary terminal hole. The first auxiliary terminal L1 may be arranged in multiple manners, as long as a sealed connection is ensured between the first auxiliary terminal L1 and the insulating cover 1 and the first auxiliary terminal L1 is electrically connected to the conductive layer 14. For example, the first auxiliary terminal L1 is encapsulated in the auxiliary terminal hole through a sealant, and the bottom of the first auxiliary terminal L1 is conducted with the conductive layer 14 by contacting. Or, the conductive layer 14 at least partially covers the inner wall of the auxiliary terminal hole, and the first auxiliary terminal L1 is hermetically welded in the auxiliary terminal hole and conducted with the conductive layer 14 in the auxiliary terminal hole. At this time, the first auxiliary terminal L1 can be directly electrically connected with the conductive layer 14 on the inner surface of the top of the insulating cover 1 without completely penetrating through the auxiliary terminal hole, as long as the first auxiliary terminal L1 can be electrically connected with the conductive layer 14 on the inner surface of the auxiliary terminal hole through a welding material.

In the present detailed embodiment, the outer surface of the insulating cover 1 is provided with a clearance slot 13, the clearance slot 13 extends at the midpoint of a connecting line of the two static contact bridges 3 along a vertical line vertical to the connecting line of the two static contact bridges 3 and parallel to the outer surface of the insulating cover 1, and the auxiliary terminal hole is located in the clearance slot 13. The clearance slot 13 can effectively increase the creepage distances between the two static contact bridges 3 outside the insulating cover 1 and between the static contact bridges 3 and the first auxiliary terminal L1, so that the auxiliary detection structure is safer (it could be understood that the present application is not limited to the clearance slot 13, and other structures may also be used as long as the distance between the two static contact bridges 3 on the outer surface of the insulating cover 1 and the distance between the static contact bridges 3 and the first auxiliary terminal L1 on the outer surface of the insulating cover 1 can be increased). As described above, in order to increase the creepage distance more fully, the auxiliary terminal hole is preferably located at the edge of the insulating cover 1, and at this time, the first auxiliary terminal L1 is located at the edge of the insulating cover 1.

Similarly, two blocking portions 12 protruding down may also be arranged on the inner surface of the top of the insulating cover 1. The two blocking portions 12 are arranged oppositely. Also, the conductive layer 14 and the yielding portion (the inner recessed hole 15' or the inner groove 15) are located between the two blocking portions 12. The blocking portions 12 can effectively increase the creepage distances between the two static contact bridges 3 inside the insulating cover 1 and between the static contact bridges 3 and the first auxiliary terminal L1, and at the same time, prevent copper cuttings from splashing during arc discharge to conduct the main contacts and the auxiliary contacts, thereby ensuring the accuracy and safety of the auxiliary detection circuit of the relay.

The second auxiliary terminal L2 can be connected to any part, electrically connected to the drive shaft 4, of the driving mechanism. In other words, it is connected to the core metal member defined above, for example, the second auxiliary terminal L2 is connected to the upper yoke 51 or the sleeve 7. The second auxiliary terminal L2 is welded to the upper yoke 51 in this example. As another alternative, in the case where the aforementioned drive shaft 4 is a conductor, the conductive member 16, the auxiliary spring 17, and the conductive fixed member 18 are electrically connected with the moving core 6, the static core 5 and the sleeve 7, and the upper yoke 51 through the drive shaft 4. The sleeve 7 and the upper yoke 51 which are external components of the relay can be directly used as second auxiliary terminals L2. During use, the sleeve 7 and the upper yoke 51 only need to be electrically connected to the auxiliary detection circuit through wires.

The first auxiliary terminal L1 and the second auxiliary terminal L2 do not need to be particularly limited in shape or structure as long as they can be electrically connected with said core metal member and connected with the external auxiliary detection circuit.

The first auxiliary terminal L1 is not particularly limited in material, and is generally made of metal having good conductivity and relatively low hardness.

For example, the first auxiliary terminal L1 is made of copper, stainless steel, aluminum, copper alloy or other metal. In this example, the first auxiliary terminal L1 is made of copper. That is, the first auxiliary terminal L1 is formed by processing a copper wire (or a copper core) made of copper. The diameter of the copper wire can be adjusted according to the actual situation, for example, can be 0.5-2 mm.

The sealed mounting method of the first auxiliary terminal L1 is not particularly limited, and may be gluing or brazing.

For example, the first auxiliary terminal L1 is encapsulated in the auxiliary terminal hole through a sealant. The sealant may be epoxy resin and the like.

For another example, a brazing method may also be adopted, the conductive layer 14 at least partially covers the inner wall of the auxiliary terminal hole, and the first auxiliary terminal L1 is hermetically welded in the auxiliary terminal hole through a silver copper solder.

As shown in FIG. 2 to FIG. 12, said auxiliary conduction structure includes a conductive member 16, an elastic member such as a conductive auxiliary spring 17 and a conductive fixed member 18 arranged in sequence from top to bottom. The conductive fixed member 18 is fixed on the drive shaft 4 above the moving contact bridge 2 (specifically, above the upper insulating cover 42). The two ends of the auxiliary spring 17 respectively abut against the conductive fixed member 18 and the conductive member 16. The conductive member 16 is arranged on the drive shaft 4 and can move along the drive shaft 4. When the drive shaft 4 moves up, the moving contact bridge 2 can be driven to be conducted with the static contact bridges 3, and the conductive member 16 is driven simultaneously to be in contact with and conducted with the conductive layer 14. When the drive shaft 4 moves down, the moving contact bridge 2 can be driven to be disconnected from the static contact bridges 3, and the conductive member 16 is driven simultaneously to be disconnected from the conductive layer 14.

The auxiliary spring 17 elastically supports the conductive member 16 below the conductive member 16, and the buffer spring 8 elastically supports the lower insulating cover 41 and the moving contact bridge 2 below the lower insulating cover 41. In addition, the driving mechanism is used for driving the drive shaft 4 to move up and down so that the moving contact bridge 2 is conducted with or disconnected from the static contact bridges 3. Thus, it should be noted that, due to the buffering action provided by the auxiliary spring 17 and the buffer spring 8, in the present subject matter, at the moment when the upward movement of the drive shaft 4 drives the moving contact bridge 2 to be conducted with the static contact bridges 3, the conductive member 16 does not have to be conducted with the conductive layer 14 at the same moment, as long as the conductive member 16 moves up synchronously with the drive shaft 4 and is in stable contact with and conducted with the conductive layer 14 when the driving mechanism drives the drive shaft 4 to move up until the moving contact bridge 2 is in stable contact with and conducted with the static contact bridges 3. Similarly, at the moment when the downward movement of the drive shaft 4 drives the moving contact bridge 2 to be disconnected from the static contact bridges 3, the conductive member 16 does not have to be disconnected from the conductive layer 14 at the same moment, as long as the conductive member 16 moves down synchronously with the drive shaft 4 and is completely disconnected from the conductive layer 14 when the driving mechanism drives the drive shaft 4 to move down until the moving contact bridge 2 is completely disconnected from the static contact bridges 3.

Above mentioned conductive fixed member 18 is used for fixedly supporting the auxiliary spring 17 and achieving the electrical connection between the auxiliary spring 17 and the drive shaft 4. In this embodiment, the conductive fixed member 18 may be a clamping spring. Above mentioned conductive member 16 is in contact with and electrically connected with the auxiliary spring 17. For example, the conductive member 16 may be a metal washer. The conductive member 16, the auxiliary spring 17 and the conductive fixed member 18 are all sleeved on the drive shaft 4, the lower end of the auxiliary spring 17 abuts against the conductive fixed member 18 and is supported by the conductive fixed member 18, and the upper end of the auxiliary spring 17 abuts against the conductive member 16 and applies an upward tension to the conductive member 16. When the conductive member 16 moves up along with the drive shaft 4 and contacts the conductive layer 14, the auxiliary spring 17 provides a buffer allowance while ensuring close contact of the conductive member 16 and the conductive layer 14, so that the entire structure is more stable. The conductive member 16 can move up and down on the drive shaft 4.

In order to improve the service stability of the auxiliary conduction structure, a limiting structure may also be arranged on the drive shaft 4 to limit the conductive member 16 above the conductive member 16. In this embodiment, the upper end of the drive shaft 4 forms a limiting portion 4*a*. The outer diameter of the limiting portion 4*a* is greater than the inner diameter of the conductive member 16 and smaller than the outer diameter of the conductive member 16. At this time, the top of the drive shaft 4 forms a "T"-shaped structure.

It can be understood that when the auxiliary conduction structure moves up along with the drive shaft 4, the top of the drive shaft 4 penetrates into the inner groove 15 or the inner recessed hole 15', and the conductive member 16 is in contact with and conducted with the conductive layer 14 at the opening edge of the inner groove 15 or the inner recessed hole 15'. That is, the conductive layer 14 needs to correspond to the conductive member 16, and is specifically located right above the conductive member 16.

In this way, when the relay is used, the first auxiliary terminal L1 and the second auxiliary terminal L2 are connected with the external auxiliary detection circuit, so that the external auxiliary detection circuit, the first auxiliary terminal L1, the second auxiliary terminal L2 and the above core metal members constitute a circuit, which is called an auxiliary detection circuit to distinguish the main circuit from the control circuit.

The mounting process of the relay is as follows: first, the conductive layer 14 is metalized in the corresponding area of the insulating cover 1. Second, the first auxiliary terminal L1, the static contact bridges 3 and the connecting table 10 are welded on the insulating cover 1, and then the conductive member 16, the auxiliary spring 17, the conductive fixed member 18, the upper insulating cover 42, the moving contact bridge 2, the lower insulating cover 41, the buffer spring 8 and the washer 81 are mounted to the drive shaft 4 and finally fixed by the clamping spring 82. Third, the upper yoke 51, the static core 5, the reset spring 9, the moving core 6 and the sleeve 7 are sequentially mounted to the drive shaft 4, and the moving core 6 is fixed to the drive shaft 4 by means of laser welding or threaded connection to obtain the driving mechanism mounted with the drive shaft 4. Fourth, the sleeve 7 is welded to the lower portion of the upper yoke 51, and then the welded insulating cover 1 and the driving mechanism assembled with the drive shaft 4 are welded to the connecting table 10. Finally, the coil, a housing (not shown in the figures) and the like are assembled outside the sleeve 7 to obtain the relay provided in this example.

The working process of the relay is described as follows: the first auxiliary terminal L1 and the second auxiliary terminal L2 are connected with the external auxiliary detection circuit, so that the external auxiliary detection circuit, the first auxiliary terminal L1, the second auxiliary terminal L2 and the above core metal member constitute an auxiliary detection circuit. As shown in FIG. 2 to FIG. 5, when the coil is not powered on, the moving contact bridge 2 and the static contact bridge 3 are disconnected, the relay is not turned on, the conductive member 16 at the top of the drive shaft 4 is disconnected from the conductive layer 14 on the inner surface of the top of the insulating cover 1 at the same time, and the auxiliary detection circuit detects that the drive shaft 4 is not conducted with the first auxiliary terminal L1, proving that the relay is not turned on. As shown in FIG. 6 to FIG. 9, when the coil is powered on, the moving core 6 is driven to drive the fixed drive shaft 4 to drive the moving contact bridge 2 to contact the static contact bridges 3 fixed on the ceramic cavity, the relay works normally, the conductive member 16 at the top of the drive shaft 4 is in contact with and conducted with the conductive layer 14 on the inner surface of the top of the insulating cover 1 at the same time so that the first auxiliary terminal L1 is conducted with the drive shaft 4, and the circuit is turned on at the moment. The auxiliary detection circuit detects that the drive shaft 4 is conducted with the first auxiliary terminal L1, which proves that the relay works normally.

When the relay needs to be turned on but the contacts are not conducted, the relay is not turned on, but the auxiliary detection circuit detects that the relay is in a turn-on state (that is, the drive shaft 4 has driven the moving contact bridge 2 to move up), and it is thus determined that the main circuit is not turned on due to the failure of the contacts. On the contrary, when the contacts need to be disconnected but the contacts are still stuck, the relay is actually in a power-on state, the auxiliary detection circuit detects that the relay is in a short-circuit state (that is, the drive shaft 4 has driven the moving contact bridge 2 to move down), and it is thus determined that the relay is in a turn-on state due to sticking of the contacts, which is beneficial to eliminating safety hazards.

The foregoing descriptions are merely preferred embodiments of the present subject matter, but are not intended to limit the present subject matter. Any modification, equivalent substitution, improvement or the like made within the spirit and principle of the present subject matter shall fall within the protection scope of the present subject matter.

What is claimed is:

1. A relay, comprising an insulating cover, two static contact bridges, a moving contact bridge, a drive shaft and a driving mechanism, wherein the two static contact bridges are fixedly mounted on the insulating cover;

an upper end of the drive shaft stretches into the insulating cover, and the moving contact bridge is mounted at an upper portion of the drive shaft;

the driving mechanism is mounted at a lower end of the drive shaft for driving the drive shaft to drive the moving contact bridge to move;

an inner surface of a top of the insulating cover is further provided with a conductive layer;

the relay further comprises an auxiliary conduction structure and an auxiliary detection structure;

the auxiliary conduction structure comprises an elastic member and a conductive member; the elastic member elastically supports the conductive member under the conductive member; the conductive member is arranged on the drive shaft and can move along the drive shaft; when the drive shaft axially moves up, the moving contact bridge is driven to be conducted with the static contact bridges, and at the same time, the conductive member is driven to be in contact with and conducted with the conductive layer; when the drive shaft axially moves down, the moving contact bridge is driven to be disconnected from the static contact bridges, and at the same time, the conductive member is driven to be disconnected from the conductive layer;

the auxiliary detection structure comprises a first auxiliary terminal and a second auxiliary terminal;

the first auxiliary terminal is arranged at the top of the insulating cover and electrically connected to the conductive layer; and the second auxiliary terminal is electrically connected to the conductive member.

2. The relay according to claim 1, wherein the inner surface of the top of the insulating cover has a yielding portion into which a top of the drive shaft stretches.

3. The relay according to claim 2, wherein the drive shaft is a conductor;

the conductive member is electrically connected to the drive shaft; and the second auxiliary terminal is arranged on the driving mechanism and electrically connected to the drive shaft.

4. The relay according to claim 3, wherein the elastic member is a conductive auxiliary spring;

the auxiliary conduction structure further comprises a conductive fixed member below the auxiliary spring;

the conductive fixed member is fixed on the drive shaft above the moving contact bridge; and the two ends of the auxiliary spring respectively abut against the conductive fixed member and the conductive member.

5. The relay according to claim 2, wherein the top of the drive shaft has a limiting portion for limiting the conductive member to move up; and the elastic member makes the conductive member abut against the limiting portion.

6. The relay according to claim 2, wherein an inner groove as the yielding portion is formed in the inner surface of the top of the insulating cover; and the conductive layer simultaneously covers at least part of the inner surface of the insulating cover and part of an inner surface of the inner groove.

7. The relay according to claim 2, wherein an inner recessed hole as the yielding portion is formed in the inner surface of the top of the insulating cover; and the conductive layer covers at least part of the inner surface of the insulating cover at the edge of the inner recessed hole.

8. The relay according to claim 2, wherein the inner surface of the top of the insulating cover has a boss extending down, and the boss is partially sunken upward to form the yielding portion;

the yielding portion is an inner groove, and the conductive layer simultaneously covers at least part of a lower surface of the boss and part of an inner surface of the inner groove;

or, the yielding portion is an inner recessed hole; and the conductive layer covers at least part of the lower surface of the boss at an edge of the inner recessed hole.

9. The relay according to claim 2, wherein the inner surface of the top of the insulating cover is provided with two blocking portions protruding down; the two blocking portions are arranged oppositely; and the conductive layer and the yielding portion are located between the two blocking portions.

10. The relay according to claim 1, wherein the top of the insulating cover has an auxiliary terminal hole penetrating the insulating cover; the auxiliary terminal hole is located in the coverage area of the conductive layer;

the first auxiliary terminal is encapsulated in the auxiliary terminal hole through a sealant, and the bottom of the first auxiliary terminal is in contact with and conducted with the conductive layer.

11. The relay according to claim 1, wherein the top of the insulating cover has an auxiliary terminal hole penetrating the insulating cover; the auxiliary terminal hole is located in the coverage area of the conductive layer;

the conductive layer at least partially covers an inner wall of the auxiliary terminal hole, and the first auxiliary terminal is hermetically welded in the auxiliary terminal hole and conducted with the conductive layer in the auxiliary terminal hole.

12. The relay according to claim 2, wherein the outer surface of the insulating cover is provided with a clearance slot, and the clearance slot extends at a midpoint of a connecting line of the two static contact bridges along a vertical line vertical to the connecting line of the two static contact bridges and parallel to the outer surface of the insulating cover; and the first auxiliary terminal is located in the clearance slot.

13. The relay according to claim 12, wherein the first auxiliary terminal is located at the edge of the insulating cover.

14. The relay according to claim 1, wherein the moving contact bridge is mounted at the upper portion of the drive shaft through an insulating component;

the insulating component comprises an upper insulating cover and a lower insulating cover, and the upper insulating cover and the lower insulating cover are combined and sleeved at the upper end of the drive shaft to mount the moving contact bridge on the drive shaft in an insulating manner.

15. The relay according to claim 14, wherein the driving mechanism comprises an upper yoke, a static core, a moving core, a sleeve, a reset spring, a buffer spring and a coil;

the upper yoke is connected with the insulating cover through a connecting table; an enclosed space is formed between the upper yoke and the insulating cover; a shaft hole is formed in a center of the upper yoke;

the lower end of the drive shaft extends out of the shaft hole; the static core is sleeved on the drive shaft below the upper yoke, and the moving core is fixedly mounted at the lower end of the drive shaft;

the reset spring is sleeved on the drive shaft between the static core and the moving core;

the buffer spring is sleeved on the drive shaft in an enclosed space between the upper yoke and the insulating cover, an upper end of the buffer spring abuts against the lower insulating cover, a lower end of the buffer spring abuts against a washer, and a lower end of the washer is limited by a clamping spring;

the sleeve is sleeved outside the static core and the moving core, with an upper opening welded with the upper yoke; and the coil is mounted outside the sleeve below the upper yoke.

16. The relay according to claim 15, wherein the second auxiliary terminal is connected to the upper yoke or the sleeve.

17. The relay according to claim 3, wherein the inner surface of the top of the insulating cover is provided with two blocking portions protruding down; the two blocking portions are arranged oppositely; and the conductive layer and the yielding portion are located between the two blocking portions.

18. The relay according to claim 4, wherein the inner surface of the top of the insulating cover is provided with two blocking portions protruding down; the two blocking portions are arranged oppositely; and the conductive layer and the yielding portion are located between the two blocking portions.

19. The relay according to claim 5, wherein the inner surface of the top of the insulating cover is provided with two blocking portions protruding down; the two blocking portions are arranged oppositely; and the conductive layer and the yielding portion are located between the two blocking portions.

20. The relay according to claim 6, wherein the inner surface of the top of the insulating cover is provided with two blocking portions protruding down; the two blocking portions are arranged oppositely; and the conductive layer and the yielding portion are located between the two blocking portions.

* * * * *